US006790146B2

(12) United States Patent
Comand

(10) Patent No.: US 6,790,146 B2
(45) Date of Patent: Sep. 14, 2004

(54) APPARATUS FOR AMUSEMENT

(75) Inventor: Alberto Comand, Altavilla Vicentina (IT)

(73) Assignee: Antonio Zamperla S.p.A., Altavilla Vicentina (IT)

( * ) Notice: Subject to any disclaimer, the term of this patent is extended or adjusted under 35 U.S.C. 154(b) by 0 days.

(21) Appl. No.: 10/404,569

(22) Filed: Apr. 1, 2003

(65) Prior Publication Data

US 2004/0116194 A1 Jun. 17, 2004

(30) Foreign Application Priority Data

Nov. 18, 2002 (IT) ..... M12002A002443

(51) Int. Cl.[7] ..... A63G 1/08

(52) U.S. Cl. ..... 472/29; 472/36; 472/128; 273/349

(58) Field of Search ..... 472/27, 29, 36, 472/43, 128; 434/226; 273/348, 349, 355, 407

(56) References Cited

U.S. PATENT DOCUMENTS

| | | | | | |
|---|---|---|---|---|---|
| 2,698,178 | A | * | 12/1954 | Williams | 472/36 |
| 3,417,991 | A | * | 12/1968 | Jindrich | 472/28 |
| 5,011,161 | A | * | 4/1991 | Galphin | 273/349 |
| 5,785,592 | A | * | 7/1998 | Jacobsen | 463/7 |
| 6,210,287 | B1 | * | 4/2001 | Briggs | 472/128 |

* cited by examiner

*Primary Examiner*—Kien Nguyen
(74) *Attorney, Agent, or Firm*—Ladas & Parry

(57) ABSTRACT

Apparatus for amusement, unusually capable of causing the user to interact while it is in operation, comprising a structure capable of rotating about an axis and a support for receiving at least one user associated with the structure in its rotary motion about an axis. The structure comprises at least one target. In addition to this, activating mechanism operatively associated with the support to receive at least one user are provided, the activating mechanism being capable of causing the support to receive at least one user to move along at least one direction jointly with the said structure. A device for projecting detection mechanism against the target operatively connected to the support to receive at least one user can be activated by the user himself.

15 Claims, 2 Drawing Sheets

APPARATUS FOR AMUSEMENT

BACKGROUND OF THE INVENTION

This invention relates to apparatus for amusement comprising a structure capable of rotating about an axis and means to receive at least one user associated with the said structure in its rotary motion about an axis. Apparatus for amusement of the type described above, also referred to as a roundabout, which comprise a generally circular platform which rotates about a vertical axis, is known. The platform comprises a plurality of seating positions of a great variety of shape and size such as, among others, animals or vehicles, depending upon the theme on which the roundabout is based.

Although satisfying the requirement of providing an apparatus suitable for the amusement of users, known items of apparatus have some disadvantages, above all the fact that users have little possibility of interacting with the functioning of the apparatus. In addition to this the mobility of the seating positions with respect to the roundabout is rather restricted.

There has arisen from the above a feeling that there is a need to provide apparatus for amusement which allows users to interact with the functioning of the apparatus. A further requirement is that of providing apparatus for amusement which makes it possible to allow further and more emphatic movements by the user in relation to the structure thus permitting more marked interaction between the user and the functioning of the apparatus.

SUMMARY OF THE INVENTION

The problem underlying this invention is therefore that of providing apparatus for amusement which has structural and functional characteristics which will satisfy the above-mentioned need and at the same time overcome the disadvantages mentioned with reference to the known art. This problem has been resolved through apparatus for amusement of the type indicated above and constructed in accordance with claim 1.

BRIEF DESCRIPTION OF THE DRAWINGS

Other advantages and characteristics of the present invention will become clear from the following detailed description which is given with reference to the appended drawings which are provided purely by way of non-limiting example and in which.

DESCRIPTION OF THE PREFERRED EMBODIMENTS

Figure 1:
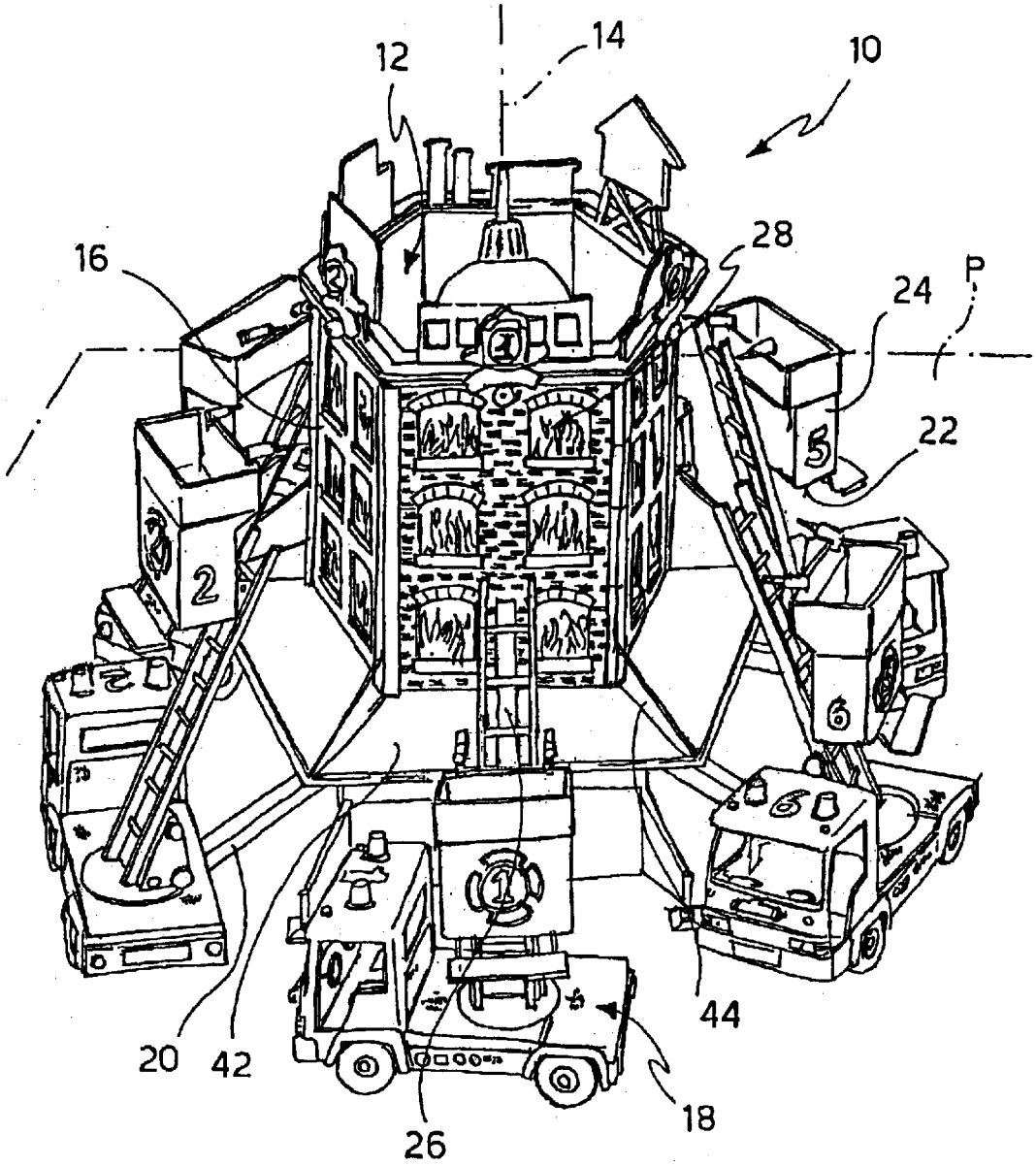
FIG. 1 illustrates a perspective view of apparatus for amusement according to this invention.

With reference to the aforesaid figures, 10 indicates apparatus for amusement as a whole. In order to define an absolute reference system, by horizontal is meant a plane parallel to a plane P substantially supporting the amusement apparatus 10, while by vertical is meant a direction or plane perpendicular to plane P.

12 indicates a structure which is capable of rotating about an axis 14. In accordance with a possible embodiment axis 14 is positioned vertically. In accordance with a possible embodiment structure 12 comprises a polygonal member provided with a plurality of side walls 16. In the example illustrated in FIG. 1, structure 12 is a structure having a hexagonal base with six side walls 16. Apparatus for amusement 10 also comprises means to receive at least one user associated with structure 12 in its rotary motion around axis 14.

In accordance with a possible embodiment apparatus 10 comprises at least one support 18 which is incorporated in structure 12 in its rotary motion around axis 14. In the example illustrated in the figure as many supports as there are side walls in structure 12 are provided. According to a possible embodiment support 18 is incorporated in structure 12 through an arm 20 which extends from the structure radially.

In accordance with a possible embodiment apparatus 10 comprises means for receiving at least one user. Such means are for example mounted on supports 18, if present.

In accordance with a possible embodiment the means to receive at least one user comprise at least one platform 22, preferably provided with side parapets 24 constructed for example in the form of closed or enclosing walls. In the case in which a support 18 is provided, the platform is mounted on the said support, and for example can move with respect to it.

The means for receiving at least one user are operatively associated with drive means constructed in such a way as to cause the means to receive at least one user to move in at least one direction jointly with structure 12. In accordance with a possible embodiment the direction of movement of the means for receiving at least one user may for example be vertical or inclined with respect to a vertical direction. In accordance with a possible embodiment in the situation envisaged, an arm 20, the means for receiving at least one user and the drive means are mounted on the said arm. In accordance with a possible form of embodiment in the case in which a support 18 is provided, the means for receiving at least one user and the drive means are mounted on the said support.

In accordance with a possible embodiment the drive means comprise a ramp 26 on which the means for receiving at least one user are slidably mounted. In the case in which the aforesaid support 18 is present, the ramp is mounted on the support itself and projects in a direction which may be vertical or inclined with respect to a vertical direction. In the situation illustrated in the figures, the ramp is advantageously inclined in such a way that the free or top end is close to structure 12. A motor, which is not illustrated, is operatively associated with platform 22 to cause it to slide in both directions along ramp 26.

In accordance with a possible embodiment, structure 12 is provided with at least one target 28, constructed for example in the form of a window or opening in the side wall of structure 12.

In accordance with a possible embodiment, structure 12 comprises a plurality of a series of targets or windows 28, each of which is opposite a user.

In the case in which structure 12 is polygonal, each side wall 16 comprises at least one window 28 or a set of windows 28 and faces the corresponding means for receiving at least one user.

In the example illustrated in the figure, each side wall 16 comprises two vertical lines of windows 28 or openings.

30 indicates means for projectioning one or more detection means towards said target 28. In accordance with a possible embodiment projection means 30 are operatively connected to the means for receiving at least one user and are advantageously operable by the user himself.

In the case in which a platform 22 is provided, projection means 30 are mounted on the platform, for example at the end of parapets 24, if present. The projection means may be capable of operation by the user as regards either switching on or switching off or as regards orientation, or both. In accordance with a possible embodiment the projection means are mounted on the means to receive at least one user through a connection which permits rotation about at least one axis, for example a hinge, spherical or other type of connection.

According to a possible embodiment projection means 30 comprise gripping means to assist orientation by the user.

According to a possible embodiment the aforesaid detection means comprises a fluid, for example water. In addition to this the projection means comprise at least one lance mounted on the said means to receive at least one user.

Figure 2:
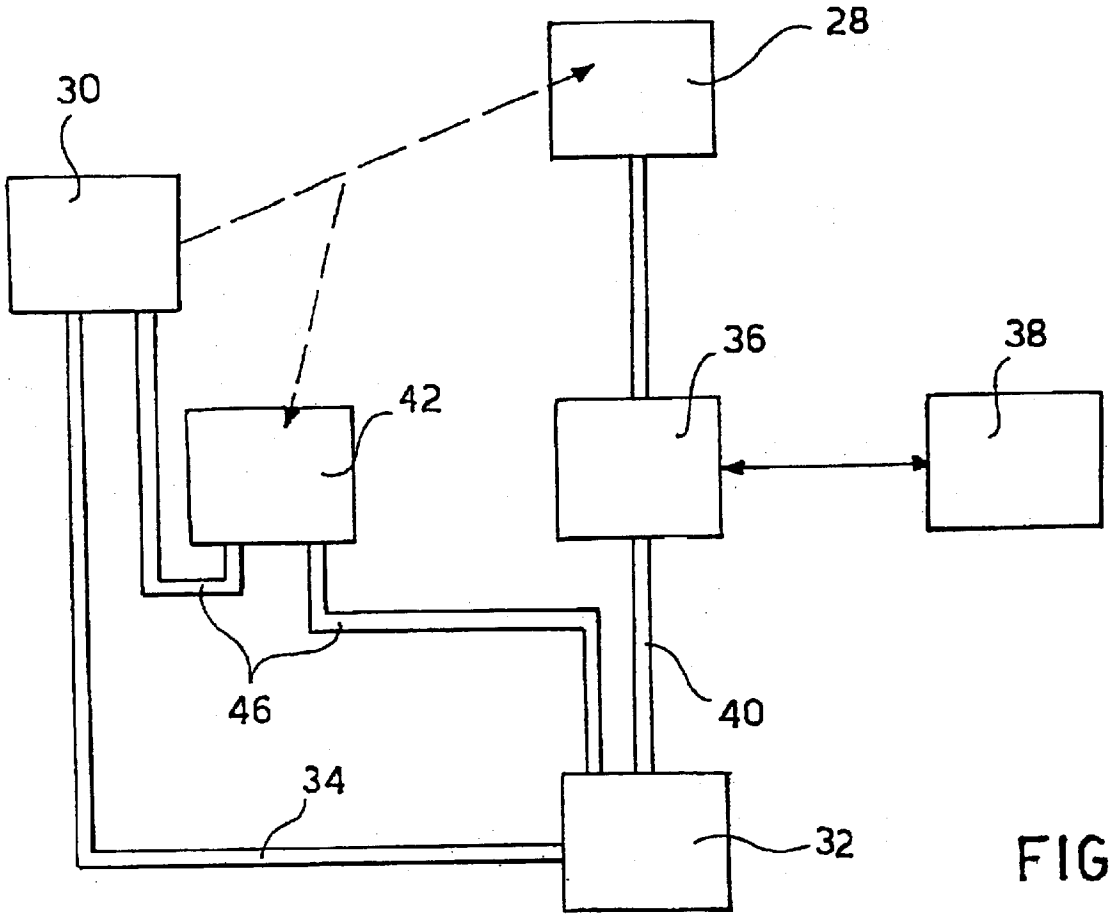
FIG. 2 illustrates a diagram of some components of the apparatus for amusement according to the invention.

Containment means 32 capable of containing the one or more detection means are indicated diagrammatically in FIG. 2. In accordance with different embodiments the containment means are mounted on the means for housing the user, or on support 18, if present, or within structure 12. Pipes 34, illustrated diagrammatically in FIG. 2, connect containment means 32 to projection means 30 and may be independent or incorporated into the components of the apparatus (for example arm 20 and ramp 26). If the detection means is a fluid, containment means 32 may be constructed as a tank and the fluid is delivered under pressure to the lances through pipes 34.

In accordance with a possible embodiment, each window 28 is connected to collection means 36 (illustrated diagrammatically in FIG. 2) which receive the one or more detection means.

In accordance with a possible further embodiment, measurement means 38 operatively associated with the collection means are also provided.

In the case of a fluid, collection means 36 may be constructed using pipes connected to the corresponding window 28. In accordance with a possible embodiment, the measuring means may be constructed as a graduated pipe or floating members which can preferably be seen from the exterior.

In accordance with a possible embodiment, further pipes. 40, illustrated diagrammatically in FIG. 2, connect collection means 36 to containment means 32, preferably with interposed interception means such as a tap.

In accordance with a possible embodiment, structure 12 comprises at least one collection member 42 placed beneath the at least one target or window 28 and capable of collecting the detecting means which do not reach the target. In the example illustrated in the figure, collection member 42 is constructed as a preferably inclined plane which extends as a bracket from structure 12. According to a possible embodiment, dividing panels 44 isolate portions of collection member 42, for example corresponding to one side wall 16 of the polygonal structure.

In accordance with a possible embodiment, collection member 42 comprises collection means 46 with projection means 30 and/or containment means 32.

The operation of the apparatus for amusement as described above is as follows, with particular reference to the embodiment illustrated in FIG. 1.

Each platform 22 may receive one or two users. When the users are in position, structure 12 begins to rotate about axis 14. Each user preferably always faces the same side wall 16.

The projection means are activated directly by the user or through an automatic control. As the structure rotates the means to receive users moves for example along ramp 26 in both directions and each user aims projection means 30 against structure 12 and in particular attempts for example to cause the fluid to enter the window.

In each run of the apparatus the "bulls eyes", that is for example, in the case of a fluid, how much fluid has been correctly aimed by each user, can be measured.

The provision of apparatus according to this invention makes it possible to satisfy the above-mentioned requirement for causing interaction by the user while the apparatus is in operation.

In addition to this the structure of the means for receiving the users and the corresponding activating means permit larger and more significant movements by the user relative to the structure. The advantageous provision of a ramp, in particular an inclined ramp, makes it possible to achieve a wide range of travel for the platform on which the user is positioned and to increase the actions which the user must perform in order to interact with operation of the apparatus. The provision of a ramp as described and illustrated may also make it possible to introduce a further degree of freedom, for example rotation of the ramp with respect to support 28.

It is clear that variants and/or additions can be made to what has been described and illustrated above. Other detection means such as, purely by way of example, bodies of a solid material, plastic balls or other objects may be used instead of the fluid.

The targets may also be of a different shape, number and arrangement from those illustrated. Instead of windows or openings solid targets which indicate when they are correctly struck, for example by electrical means, or because the detecting means are capable of remaining attached to the target, may be provided.

As an alternative to what is illustrated in the appended figures, the structure of the apparatus may have a different shape, dimensions and proportions. Solely by way of example it may be constructed as a polygonal structure with a number of side walls other than the number illustrated, or with a cylindrical wall.

The means for receiving users may be of a different shape, number and arrangement. Several supports may for example be provided for each side wall of the structure.

In accordance with a possible embodiment, lighting means, which are not illustrated, are mounted on structure 12 and directed through the fluid collected by each user.

In accordance with a possible embodiment, targets in the form of windows and means for collection from the target are not provided. In this case only collection member 42 may be provided.

In order to satisfy contingent and specific requirements a person skilled in the art could apply many modifications, adaptations and replacements of components having other additional functions to the preferred embodiment of the apparatus described above without however going beyond the scope of the following claims.

I claim:

1. Apparatus for amusement comprising:

a structure capable of rotating about an axis and means for receiving at least one user associated with the said structure in its rotary movement about the said axis, wherein the said structure comprises at least one target and:

activating means operatively associated with the said means for receiving at least one user, the said activating means being capable of causing the means for receiving at least one user to move in at least one direction jointly with the said structure, means for projecting one or more detection means towards the said target, the said projection means being operatively connected to the said means for receiving at least one user and being capable of being activated by the user himself.

2. Apparatus for amusement according to claim 1, in which the said structure comprises a plurality of sets of targets each of which faces a user.

3. Apparatus for amusement according to claim 1 or 2, in which the said structure comprises a polygonal member provided with a plurality of side walls, each of which comprises at least one target or at least one set of targets which face a user.

4. Apparatus for amusement according to claim 3, in which each side wall of the structure comprises an arm which projects radially from the structure, the said means for receiving at least one user and the said activating means being mounted on the said arm.

5. Apparatus for amusement according to claim 1, in which the said structure comprises at least one window defining the said at least one target.

6. Apparatus for amusement according to claim 5, in which the said at least one window is connected to collection means for the one or more detection means.

7. Apparatus for amusement according to claim 6, in which measurement means operatively associated with the said collection means are provided.

8. Apparatus for amusement according to claim 1, in which the said structure comprises at least one collection member located beneath at least one target and is capable of collecting the one or more detection means which do not reach the target.

9. Apparatus for amusement according to claim 8, in which the said collection member comprises means for connection to the projection means and/or containment means.

10. Apparatus for amusement according to claim 1, in which the said activating means comprise a ramp, and the said means for receiving at least one user are slidably mounted on the said ramp.

11. Apparatus for amusement according to claim 10, in which the said ramp is vertical.

12. Apparatus for amusement according to claim 10, in which the said ramp is inclined with respect to a vertical direction.

13. Apparatus for amusement according to claim 1, in which the said projection means are mounted on the said means for receiving at least one user through a connection which permits the projection means to rotate around at least one axis.

14. Apparatus for amusement according to claim 1, in which the said detection means comprises a fluid.

15. Apparatus for amusement according to claim 14, in which the said projection means comprise at least one lance mounted on the said means to receive at least one user and connection pipes between the said at least one lance and containment means for the fluid.

* * * * *